US007232012B2

(12) United States Patent
Muff et al.

(10) Patent No.: US 7,232,012 B2
(45) Date of Patent: Jun. 19, 2007

(54) ELEVATOR SHAFT DOOR

(75) Inventors: Josef A. Muff, Hildisrieden (CH); Peter A. Spiess, Meggen (CH); Jules Christen, Altdorf (CH)

(73) Assignee: Inventio AG, Hergiswil NW (CH)

( * ) Notice: Subject to any disclaimer, the term of this patent is extended or adjusted under 35 U.S.C. 154(b) by 355 days.

(21) Appl. No.: 10/748,402

(22) Filed: Dec. 30, 2003

(65) Prior Publication Data

US 2004/0173416 A1 Sep. 9, 2004

Related U.S. Application Data

(63) Continuation of application No. PCT/CH02/00341, filed on Jun. 25, 2002.

(51) Int. Cl.
*B66B 13/02* (2006.01)

(52) U.S. Cl. ..... 187/325; 187/333; 49/25; 49/366; 49/501; 49/116; 49/120; 52/30; 52/784.11

(58) Field of Classification Search ..... 187/325, 187/333, 334; 49/25, 366, 370, 501, 116, 49/120; 52/506.01, 506.05, 784.11, 656.3, 52/656.4, 30; 312/265.2, 265.3, 301, 409
See application file for complete search history.

(56) References Cited

FOREIGN PATENT DOCUMENTS

| | | |
|---|---|---|
| EP | 0 479 239 | 4/1992 |
| EP | 1 083 290 | 3/2001 |

*Primary Examiner*—Gene Crawford
*Assistant Examiner*—Stefan Kruer
(74) *Attorney, Agent, or Firm*—Fraser Clemens; Martin & Miller LLC; William J. Clemens

(57) ABSTRACT

An elevator shaft door having a door panel composed of a front wall and rear wall, which walls are connected together by a thermally releasable material, wherein at least a part of the closing edge of the respective door panels consists of a profile member that is formed by the back wall or thermally non-detachably fastened to the back wall. In the case of a fire, the back wall separates from the front wall through release of the thermally releasable material, wherein the front wall curves by heat effect while the back wall with the closing edge retains the original shape.

8 Claims, 1 Drawing Sheet

ELEVATOR SHAFT DOOR

CROSS-REFERENCE TO RELATED APPLICATION

This application is a continuation of the co-pending PCT patent application Ser. No. PCT/CH02/00341, filed Jun. 25, 2002.

BACKGROUND OF THE INVENTION

The present invention relates to an elevator shaft door comprising a door panel, which panel consists at least of a front wall and a back wall which are connected together by a thermally releasable connecting means.

An elevator door leaf is shown in the European patent application EP 1 083 290, in which connecting means are provided between a front wall and back wall and release under heat effect, wherein in addition at least one heat-resistant connection is provided. The heat-resistant connection ensures that in the case of fire, the elevator door leaf does not collapse and thus can be handled as a whole, whilst the connection, which is releasable under heat effect, between front wall and back wall enables a relative movement between the two walls in the case of fire. Gluing over an area is provided as the connection releasable under heat effect, whilst rivets or screws in an upper receptacle for fastening the elevator door leaf to a suspension carriage are used as heat-resistant connections. In this manner it is achieved that, in the case of fire, on dissolution of the connection which is not heat-resistant the front wall and back wall can displace relative to one another.

In this elevator door leaf the entire closing edge is formed by the front wall. In the case of fire, i.e. with heat action on the front wall and with dissolution of the glue connections which are not heat-resistant, the front wall and therewith the closing edge will curve so that the door gap can enlarge to an impermissible width, whilst the back wall is hardly curved.

SUMMARY OF THE INVENTION

The present invention has as an object an elevator shaft door that guarantees that gap widths of impermissibly large size do not occur by heat effect in the case of fire.

The present invention concerns an elevator shaft door having a door panel with a closing edge, wherein the door panel includes a front wall and a back wall, which walls are spaced apart and connected together by thermally releasable connecting means. A profile member is thermally non-detachably fastened to the back wall of the door panel and forms a rearward portion of the closing edge of the door panel, while a portion of the front wall forms a forward portion of the closing edge of the door panel. The profile member is configured to form a rearward door gap with an adjacent closing edge of an opposite door panel or with an adjacent door post. The portion of the front wall is configured to form a forward door gap with the adjacent closing edge of the opposite door panel or with the adjacent door post and the profile member is configured to form the rearward door gap with a direction or a lateral position different from a direction or lateral position respectively of the forward door gap. Thus, at least a part of the closing edge of the door panel consists of a profile member formed by the back wall or thermally non-detachably fastened thereto.

The advantage achieved by the present invention are that in the case of fire the back walls, notwithstanding stronger curvature of the front door walls of the door panel, and thus the closing edges fastened thereto remain straight. A further advantage resides in the fact that in the case of one and the same back wall the closing edge can be of variable design by fitting differently shaped profile members, which allows a more rational production and reduces manufacturing costs.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
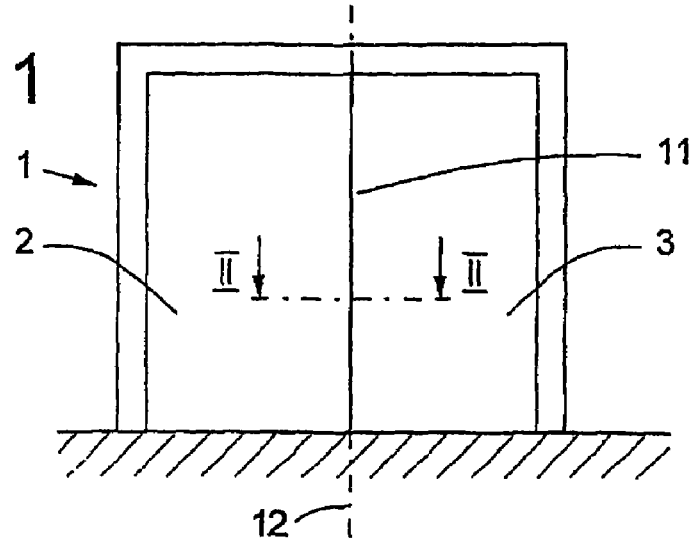
FIG. 1 is a schematic elevation view of an elevator shaft door according to the present invention with two door panels.
Figure 2:
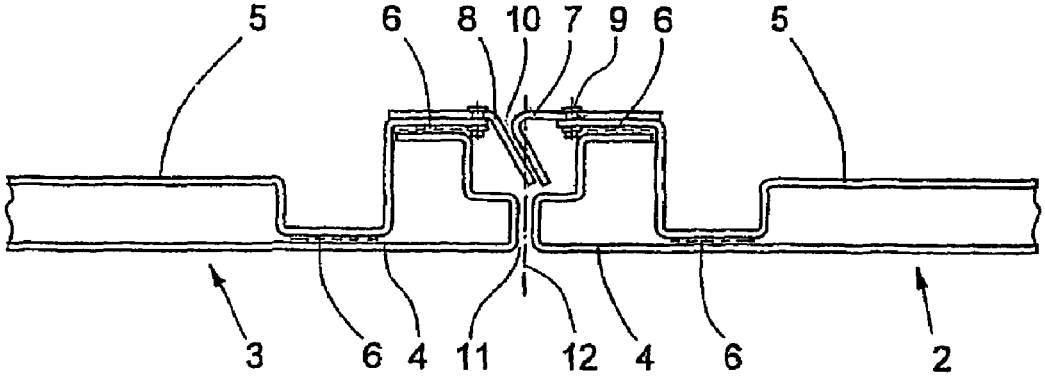
FIG. 2 is a view in partial cross-section taken along the line II—II in FIG. 1 in schematic illustration and enlarged scale.

In FIGS. 1 and 2, an elevator shaft door, which has two door panels 2, 3, is denoted by 1. The door panels 2, 3 each consist of a front wall 4 and a back wall 5, which are connected together by means of an adhesive material 6 illustrated in the drawing by dashed lines. The adhesive material 6 is of such a nature that it dissolves in the case of greater heat, for example in the case of a fire. The back wall 5 has at least a part of a closing edge of the respectively concerned door panel 2, 3, wherein the closing edge itself is preferably a profile member 7, 8 separate from the back wall 5 and fastened thereto by, for example, rivets 9. That offers the advantage that, through selection of the shape of the profile members 7, 8, closing edges extending in a different manner can be realized for one and the same back wall. However, the profile member could be an integral part of the edge portion of the back wall 5.

The profile member 7 of one door panel 2 and the profile member 8 of the other door panel 3 form, in the closed state of the elevator shaft door 1, a rearward door gap 10, which differs with respect to gap direction and/or lateral position from a forward door gap 11, which is formed in the forward region of the elevator shaft door 1 by the closing edges of the front walls 4. The rearward door gap 10 can thereby extend, for example, obliquely relative to the forward door gap 11 and in that case cross an axis 12 of symmetry of the elevator shaft door 1.

In the event of a fire the glue connection 6 dissolves due to the strong heating, so that the back walls 5 are separated from the front walls 4. In that case the front walls 4 directly exposed to the fire curve, whilst the back walls 5 and thus also the profile members 7, 8 which are fastened thereto and form the rearward door gap 10 substantially retain the original shape, so that the door gap 10 between the stated profile members 7, 8 does not enlarge and the fire cannot go through to the elevator shaft.

Figure 3:
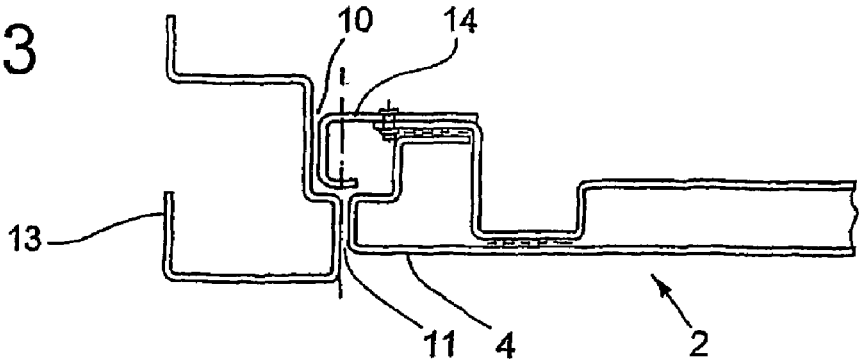
FIG. 3 is a view in partial cross-section through an elevator shaft door according to the present invention with only one door panel.

FIG. 3 shows an alternate embodiment door panel according to the present invention in an elevator shaft door with only one door panel. By contrast to the embodiment according to FIG. 2 where the closing edges of two door panels form a door gap, in this arrangement the door gap is formed between the closing edge of the door panel 2 and a door post 13. A profile member 14 of this arrangement is attached to the edge of the door panel 2, is correspondingly shaped and forms a rearward door gap 10 with the door post 13.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An elevator shaft door having a door panel with a closing edge, wherein the door panel includes a front wall and a back wall, which walls are spaced apart and connected together by thermally releasable connecting means, comprising:

a profile member thermally non-detachably fastened to the back wall of the door panel and forming a rearward portion of the closing edge of the door panel and forming a rearward door gap with an adjacent closing edge when the door is in a closed state; and a portion of the front wall forming a forward portion of the closing edge of the door panel whereby due to a heating of the door panel, the back wall including said rearward portion of the closing edge is at least partially separated from the front wall and due to the heating the front wall curves and the back wall including the rearward portion of the closing door edge substantially retains the rearward door gap unchanged.

2. The elevator shaft door according to claim 1 wherein said profile member is configured to form said rearward door gap with an adjacent closing edge of an opposite door panel or with an adjacent door post.

3. The elevator shaft door according to claim 2 wherein said portion of the front wall is configured to form a forward door gap with the adjacent closing edge of the opposite door panel or with the adjacent door post and said profile member is configured to form said rearward door gap with a direction or a lateral position different from a direction or lateral position respectively of said forward door gap.

4. The elevator shaft door according to claim 3 wherein said rearward door gap extends obliquely relative to said forward door gap and crosses an axis of symmetry of the door panel and the opposite door panel.

5. An elevator shaft door having a door panel with a closing edge, wherein the door panel includes a front wall and a back wall, which walls are spaced apart and connected together by thermally releasable connecting means, comprising:

a profile member including a first end thermally non-detachably fastened to the back wall of the door panel and including a second free end, said profile forming a rearward portion of the closing edge of the door panel and forming a rearward door gap with an adjacent closing edge when the door is in a closed state; and a portion of the front wall forming a forward portion of the closing edge of the door panel whereby due to a heating the front wall curves and the back wall including the rearward portion of the closing door edge substantially retains the rearward door gap unchanged.

6. The elevator shaft door according to claim 5 wherein said profile member is configured to form said rearward door gap with an adjacent closing edge of an opposite door panel or with an adjacent door post.

7. The elevator shaft door according to claim 6 wherein said portion of the front wall is configured to form a forward door gap with the adjacent closing edge of the opposite door panel or with the adjacent door post and said profile member is configured to form said rearward door gap with a direction or a lateral position different from a direction or lateral position respectively of said forward door gap.

8. The elevator shaft door according to claim 7 wherein said rearward door gap extends obliquely relative to said forward door gap and crosses an axis of symmetry of the door panel and the opposite door panel.

* * * * *